US010779089B1

(12) United States Patent
Schumacher et al.

(10) Patent No.: US 10,779,089 B1
(45) Date of Patent: Sep. 15, 2020

(54) THERMOACOUSTIC DEVICE WITH ACOUSTICALLY TRANSPARENT HOUSING

(71) Applicant: The United States of America as represented by the Secretary of the Navy, Newport, RI (US)

(72) Inventors: Christian R Schumacher, Newport, RI (US); Thomas R Howarth, Portsmouth, RI (US)

(73) Assignee: The United States of America as represented by the Secretary of the Navy

( * ) Notice: Subject to any disclaimer, the term of this patent is extended or adjusted under 35 U.S.C. 154(b) by 0 days.

(21) Appl. No.: 16/439,745

(22) Filed: Jun. 13, 2019

Related U.S. Application Data

(60) Provisional application No. 62/703,608, filed on Jul. 26, 2018.

(51) Int. Cl.
*H04R 23/00* (2006.01)
*H04R 1/02* (2006.01)
*G10K 15/04* (2006.01)

(52) U.S. Cl.
CPC ..... *H04R 23/002* (2013.01); *G10K 15/04* (2013.01); *H04R 1/02* (2013.01)

(58) Field of Classification Search
CPC ..... H04R 23/002; H04R 1/02; G10K 15/04
USPC ..... 381/164
See application file for complete search history.

(56) References Cited

U.S. PATENT DOCUMENTS

2015/0208175 A1* 7/2015 Pinkerton ..... H04R 1/26 381/165
2016/0157022 A1* 6/2016 Zhou ..... H04R 19/005 381/191
2016/0277851 A1* 9/2016 Bas, Jr. ..... H04R 25/402
2016/0345083 A1* 11/2016 Pinkerton ..... H04R 19/02

* cited by examiner

*Primary Examiner* — Sean H Nguyen
(74) *Attorney, Agent, or Firm* — James M. Kasischke; Michael P. Stanley

(57) ABSTRACT

A thermoacoustic device includes an outer shell having two half shells, each half shell having an outer flange and an inner region. The half shells are joined at the outer flanges such that the combined half shell inner regions define an inner cavity. A gas is provided within the outer shell inner cavity, and a substrate having electrodes is supported within the outer shell. A thermoacoustic element is mounted on the substrate in contact with the electrodes. Leads extend into the shell where they are joined to the electrodes. In further embodiments, the device is provided with a gas source and a regulator for controlling gas pressure in the inner cavity.

15 Claims, 5 Drawing Sheets

THERMOACOUSTIC DEVICE WITH ACOUSTICALLY TRANSPARENT HOUSING

STATEMENT OF GOVERNMENT INTEREST

The invention described herein may be manufactured and used by or for the Government of the United States of America for governmental purposes without the payment of any royalties thereon or therefor.

CROSS REFERENCE TO OTHER PATENT APPLICATIONS

This patent application is co-pending with provisional application 62/703,608 filed on 26 Jul. 2018 by the same inventors as this application.

BACKGROUND OF THE INVENTION

(1) Field of the Invention

The present invention is directed to a thermophone and more particularly to a thermophone in an acoustically transparent housing.

(2) Description of the Prior Art

Thermophones are devices which generate sound using heat which is supplied to an active element or filament via an alternating electric current. By Joule heating an active element, which has a low heat capacity, thermal rarefaction and contraction occurs within a small volume of gas immediately surrounding the filament producing a pressure wave. Thermophone technology has not been able to keep up with the much higher efficiencies of conventional acoustic sources such as electrodynamic loudspeakers and piezoelectric ceramics.

Carbon nanotube (CNT) structures were first described as a crystal structure in 1991. These are tiny fibrils of carbon roughly between 1 nm and 100 nm in diameter with individual lengths of up to centimeters. Many applications have been found for these structures. A group from the University of Texas at Dallas (UTD) created a method for producing CNT vertical arrays which can be spun into fibers or drawn out horizontally into thin sheets. These fibers and sheets have many applications.

It is thus desirable to provide a thermophone that can be packaged for use in any environment.

SUMMARY OF THE INVENTION

It is a first object to provide an acoustic projector.

Another object is to provide a compact acoustic projector capable of producing low frequency sound.

Accordingly, there is provided a thermoacoustic device that includes an outer shell having two half shells, each half shell having an outer flange and an inner region. The half shells are joined at the outer flanges such that the combined half shell inner regions define an inner cavity. A gas is provided within the outer shell inner cavity, and a substrate having electrodes is supported within the outer shell. A thermoacoustic element is mounted on the substrate in contact with the electrodes. Leads extend into the shell where they are joined to the electrodes. In further embodiments, the device is provided with a gas source and a regulator for controlling gas pressure in the inner cavity.

BRIEF DESCRIPTION OF THE DRAWINGS

Reference is made to the accompanying drawings in which are shown an illustrative embodiment of the invention, wherein corresponding reference characters indicate corresponding parts, and wherein.

DETAILED DESCRIPTION OF THE INVENTION

Figure 1:
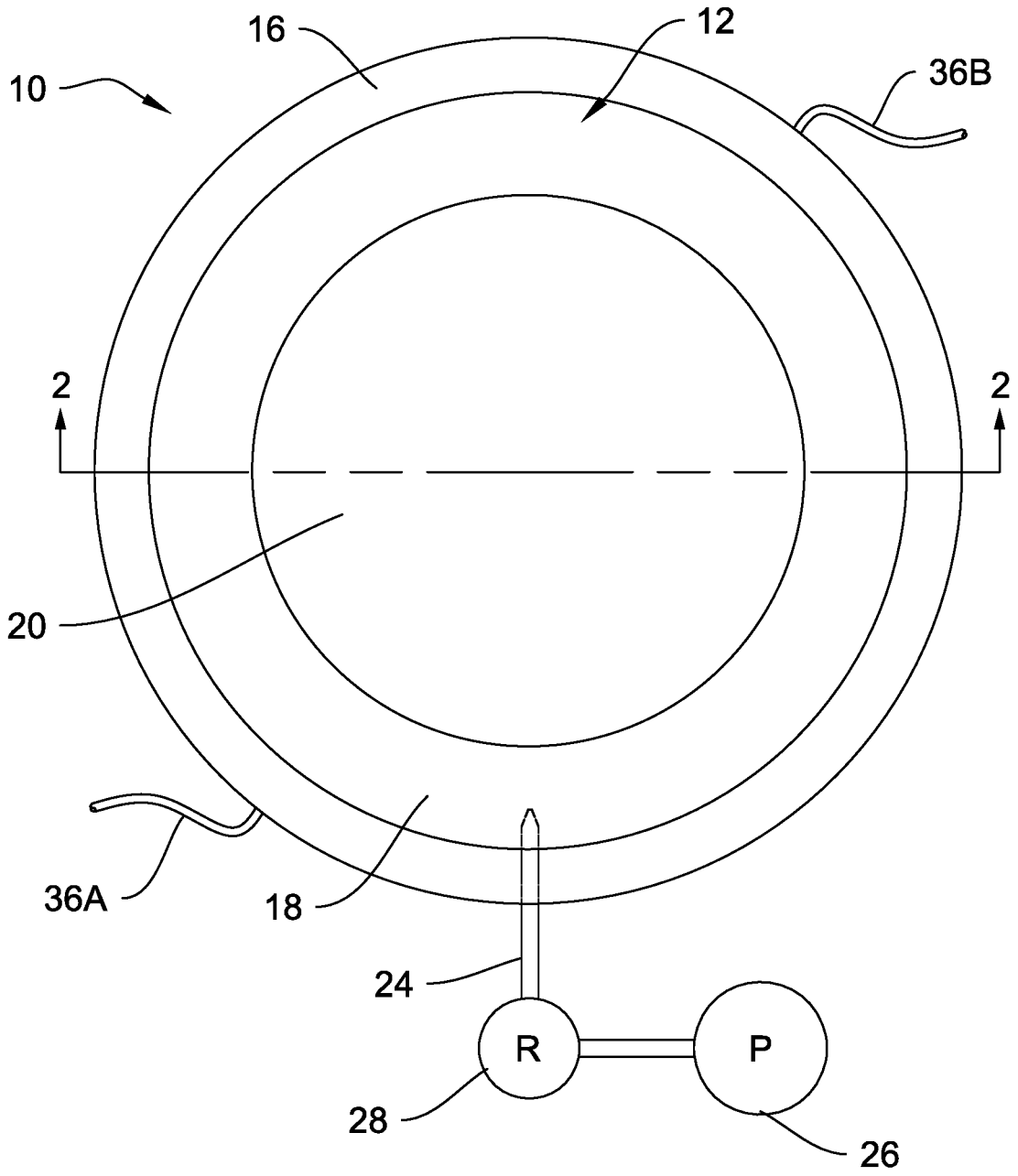
FIG. 1 is a top view of a thermoacoustic device.
Figure 2:
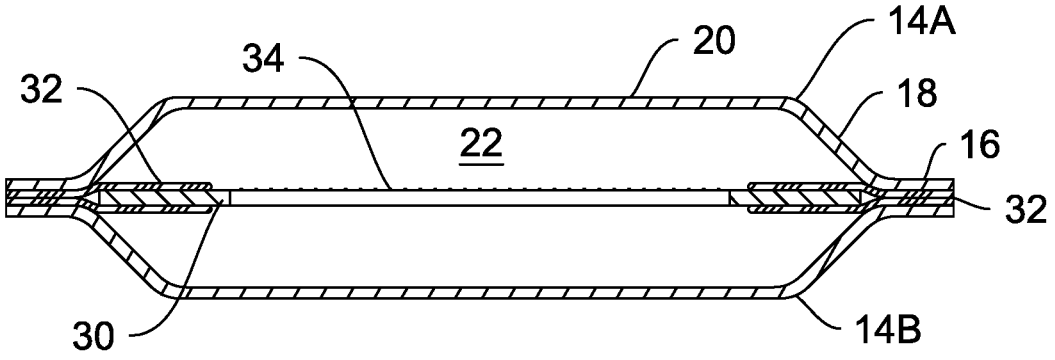
FIG. 2 is a cut away view of a thermoacoustic device taken along line 2-2 of FIG. 1.

FIG. 1 and FIG. 2 provide an overview of a carbon nanotube thermophone assembly 10. FIG. 2 provides a cross-sectional view of assembly 10 taken along section line 2-2 of FIG. 1. Assembly 10 includes an outer shell 12 made from two half shells 14A and 14B. Each half shell 14A and 14B is made from an aluminum/polymer composite material formed in a dish shape having an outer flange 16, a transition region 18, and an inner region 20. Half shells 14A and 14B are shaped so that when assembled concentrically, facing one another, corresponding outer flanges 16 will be in contact with each other. Half shells 14A and 14B can have wings extending outwardly from outer flange 16 for alignment during assembly and mounting after assembly. (See FIG. 7.) An inner cavity 22 is defined in the volume between transition regions 18 and inner regions 20. Inner cavity 22 volume should be tailored to the low frequency resonance of the thermophone 10 for maximum efficiency.

A pressurization tube 24 can be positioned in communication between inner cavity 22 and a pressure source 26 via a regulator 28. Pressurization tube 24 allows cavity 22 to be filled with a gas at a known pressure. Without further enhancement shell 12 can be pressurized up to 40 psi. The chemical gas composition can be tailored to provide preferred heat transfer while being chemically non-reactive. The particular fill gas also affects the frequency response. Argon and helium have been used, and argon is preferred, as the larger molecule does not diffuse or leak as easily. Inert gases are preferred over other gases.

As shown in FIG. 2, a substrate 30 is suspended in cavity 22 by tab sealant 32 adhesion. Tab sealant 32 adheres to each surface of substrate 30 and maintains substrate 30 between the assembled half shells 14A and 14B. Tab sealant 32 is further layered between outer flanges 16 of the two half shells 14A and 14B to adhere the shells 14A and 14B together. A layer of carbon nanotubes 34 is adhered to at least one side of substrate 30. Carbon nanotubes 34 are electrically connected to power leads 36A and 36B as described hereinafter. (Further description of the carbon nanotubes and substrate will be provided in the description of FIG. 3.) Carbon nanotubes have a mean diameter of about 2 nm. (Figures are not drawn to scale in order to illustrate carbon nanotubes. There will also be many more nanotubes.) Power leads 36A and 36B can be joined to an oscillator that provides a difference voltage across the carbon nanotubes causing resistive (Joule) heating.

In a preferred embodiment, carbon nanotubes are available as sheets from Lintec of America, Inc. and commercialized as cYarn™. Using these carbon nanotubes, there are 7-10 nanotubes wrapped concentrically around a core having an outer diameter of 10 nm. Total outer diameter of the nanotubes and core is 4-150 μm. Multiple layers can be stacked to reduce sheet impedance and increase output amplitude. Maximum benefit is reached at 4-6 layers. Beyond this number of layers, heat transfer becomes limiting.

Figure 4:
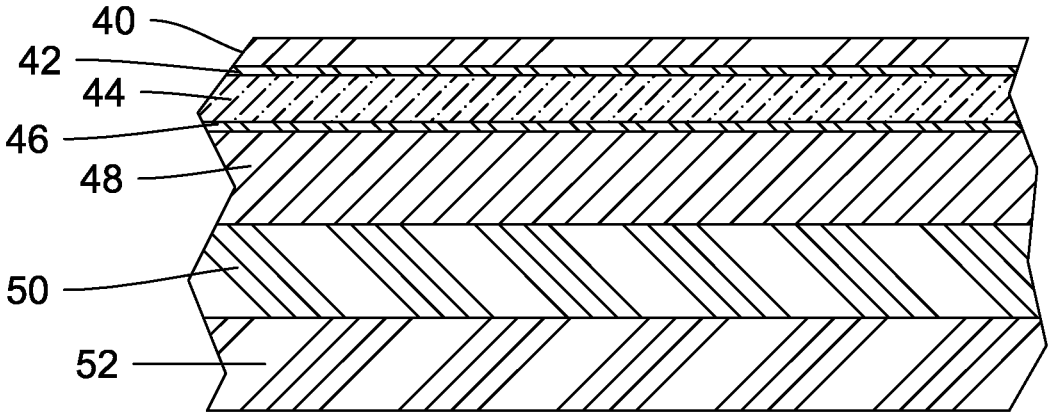
FIG. 4 is a cross sectional view of the outer shell material.

Concerning half shells 14A and 14B, these are made from a laminate in order to provide the required heat transfer and acoustic properties. A sample of a preferred laminate is shown in FIG. 4. (FIG. 4 is not drawn to scale.) Layer 40 is preferably polyethylene terephthalate (PET) having a thickness of about 12 μm. Layer 42 is preferably a dry laminate having thickness of about 3 μm. Layer 44 is made from oriented nylon having a thickness of 15 μm. Layer 46 is another layer of dry laminate having a thickness of about 3 μm. Layer 48 is made from 1000-series Aluminum (99.9+% Al) having a thickness of about 40 μm. Layer 50 is made from an acid-modified (<10%) polypropylene (PPa) having a thickness of about 40 μm. Layer 52 is a layer of polypropylene (PP) having a thickness of about 40 μm. Layers 50 and 52 are electrically non-conductive and prevent electronic components from shorting by contact with aluminum layer 48. The total thickness of each half shell should be about 153 μm. The preferred material is part number EL408 available from Hohsen Corporation. It is believed that similar materials can be used, but it is expected that these will have a metallic layer to prevent water transmission. The metallic layer can be aluminum or stainless steel. Multiple polar/non-polar layers prevent the best sealing against a variety of wet and dry conditions. In the preferred method, half shells 14A and 14B are blow molded into shape against a die.

Half shells 14A and 14B are bonded together by a heat sealing process. Sheets of tab sealant 32 are provided on either side of substrate 30 and extend outward therefrom. Flanges 16 of half shells 14A and 14B are positioned concentrically on the upper and lower surfaces of tab sealant 32 sheets. Tab sealant 32 has a multilayer construction having two relatively lower melting point polymer sheets above and below a structural polymer sheet. In a preferred embodiment, one or both lower melting point polymer sheets are acid modified polypropylene or acid modified polyethylene. The structural sheet is preferably polyethylene terephthalate (PET). Upon heat treating, layers of tab sealant 32 are bonded on either side of substrate 30. Heat treating also causes adhesion of half shell 14A and 14B flanges 16. This results in substrate 30 being suspended by tab sealant 32 in cavity 22.

Figure 3:
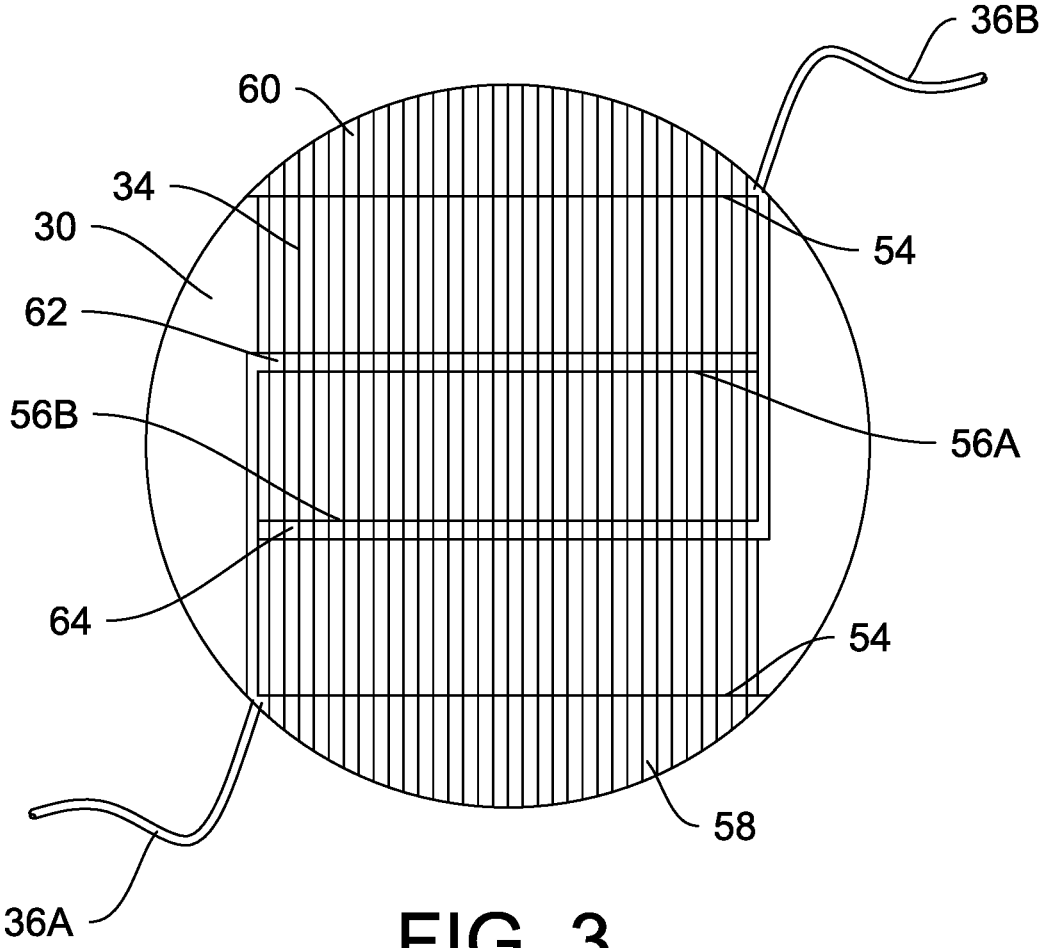
FIG. 3 is detail view of the substrate and a thermoacoustic element.

FIG. 3 provides additional detail concerning carbon nanotubes 34 and substrate 30. Substrate 30 is made from a G10 circuit board material. (G10 is a high-pressure fiberglass laminate that is well known in the art. Other substrate materials such as FR-4, Micarta®, and carbon fiber laminates could be used.) Substrate 30 has cut outs 54 that allow carbon nanotubes 34 full contact with the gas inside cavity 22. Supports 56A and 56B of substrate 30 material can be left to prevent movement of carbon nanotubes when subjected to shock or acceleration. This makes the device more shock and vibration tolerant. Because substrate 30 may be required to support the outer shell 12 when internally pressurized, supports 56A and 56B can improve the rigidity of substrate 30 allowing a higher internal pressure. Electrodes are formed on the surface of substrate 30. A first electrode 58 is deposed on a portion of substrate 30 in contact with a first end of carbon nanotubes 34, and a second electrode 60 is deposed on another portion of substrate 30 in contact with a second end of carbon nanotubes 34. First electrode 58 is in electrical contact with electrical lead 36A. Electrical lead 36B is in contact with second electrode 60. As dependent on the electrical resistance of the carbon nanotubes 34 and the operating voltages, it may be desirable to depose a first additional electrode 62 on support 56A in electrical communication with first electrode 58. A second additional electrode 64 can be deposed on support 56B and be placed in electrical communication with second electrode 60. Electrical communication between electrodes can be achieved by providing a conductive trace on substrate 30. Carbon nanotubes 34 contact first additional electrode 62 and second additional electrode 64 between the first end and the second end. Second additional electrode 64 is positioned between first electrode 58 and first additional electrode 62 along the length of carbon nanotubes 34. Likewise, first additional electrode 62 is interposed between second electrode 60 and second additional electrode 64 along the length of carbon nanotubes 34. Interdigitated electrodes such as shown here can be used to reduce sheet resistance by putting carbon nanotube sheet sections in parallel. This can be used to tailor devices to match system desired impedance to design a voltage and/or current driven device.

Figure 5:
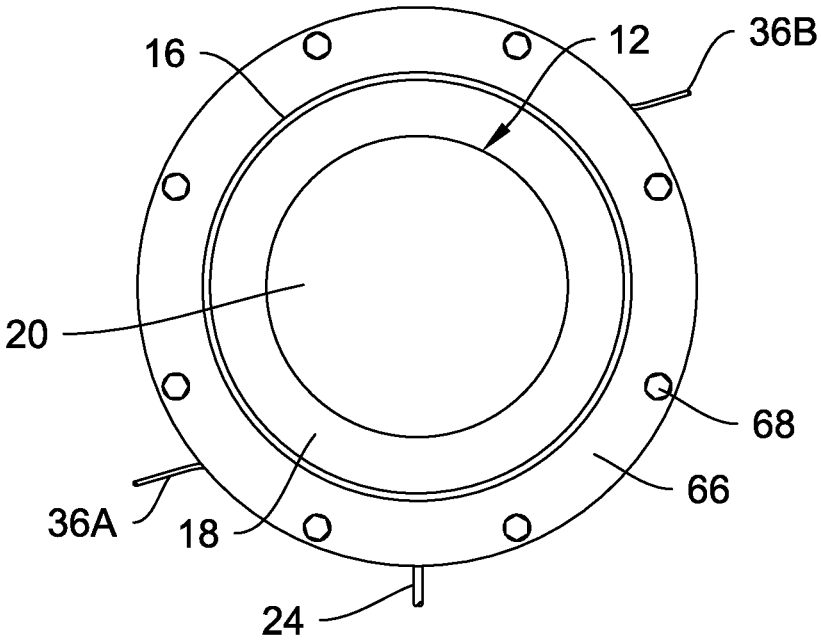
FIG. 5 is a view of an alternate embodiment.

Thermophone devices of this construction were successfully tested showing promising acoustic levels, with a particular low frequency resonance that is due to the gas bubble volume inside of the laminate housing. The outer shell 12 was tested and capable of retaining a 40 psi internal pressure. As shown in FIG. 5, in order to enhance the internal pressure capabilities, mounting rings 66 can be provided on either side of flanges 16, compressing flanges 16 against each other. Mounting rings 66 have a central aperture accommodating transition region 18 and inner region 20 of shell 12. Mounting rings 66 can be secured by fasteners 68 passing through the rings 66 from one face of a first ring to a second face of a second ring.

Figure 6:
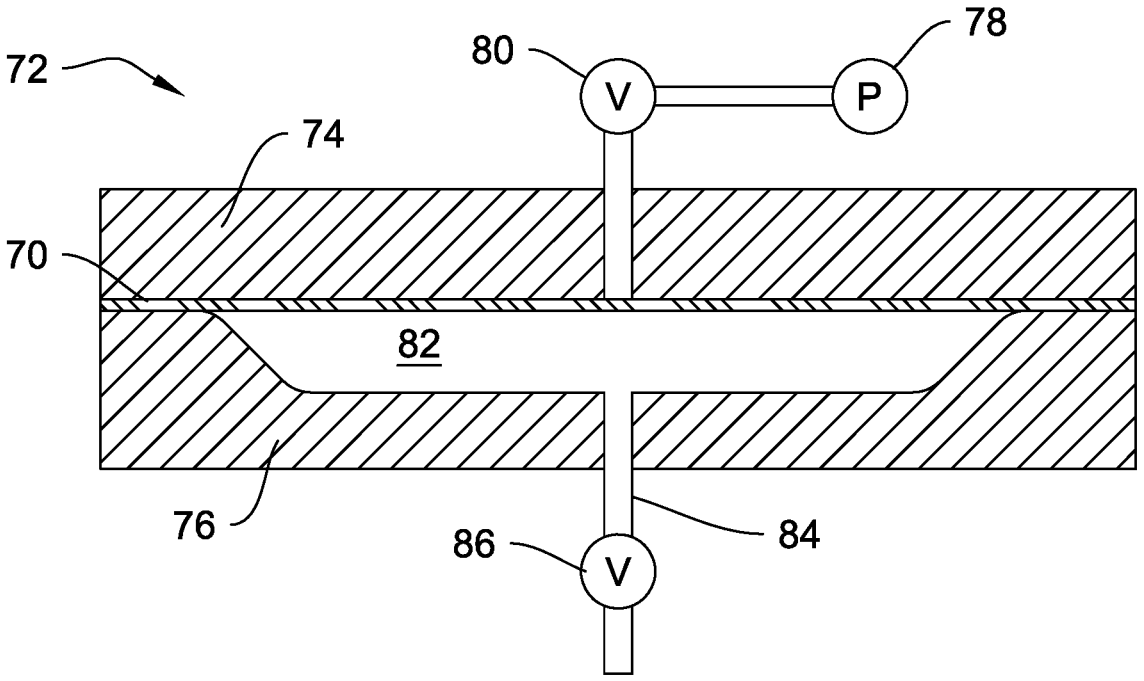
FIG. 6 is a cross sectional diagram illustrating a pressure molding process.

FIG. 6 is a cross sectional diagram illustrating a method of making a packaged thermophone. A sheet 70 of laminated material is provided in a pressure forming mold 72 having a top half 74 and a bottom half 76. A pressure source 78 and a valve 80 are joined to top half 74. Bottom half 76 has a cavity 82 formed therein for shaping the molded sheet 70. Cavity 82 can be used to make both halves 14A and 14B of outer shell 12 or different molds can be provided for each half. A port 84 is in communication with cavity 82. Port 84 can be joined to a valve 86 and a discharge pipe 88.

In operation, sheet 70 is provided on bottom half 76, and top half 74 is positioned above sheet 70 and secured. Mold 72 retains the edges of sheet 70. Valve 86 is opened to allow environmental gas in cavity 82 to escape. Valve 80 is opened to subject a top of sheet 70 to higher pressure from pressure source. The difference in pressure between top of sheet 70 and bottom of sheet 70 results in sheet 70 being molded into cavity 82 where it conforms to the shape of the cavity. The molded sheet can then be cut into the desired shape using a die cut method known in the art.

Figure 7:
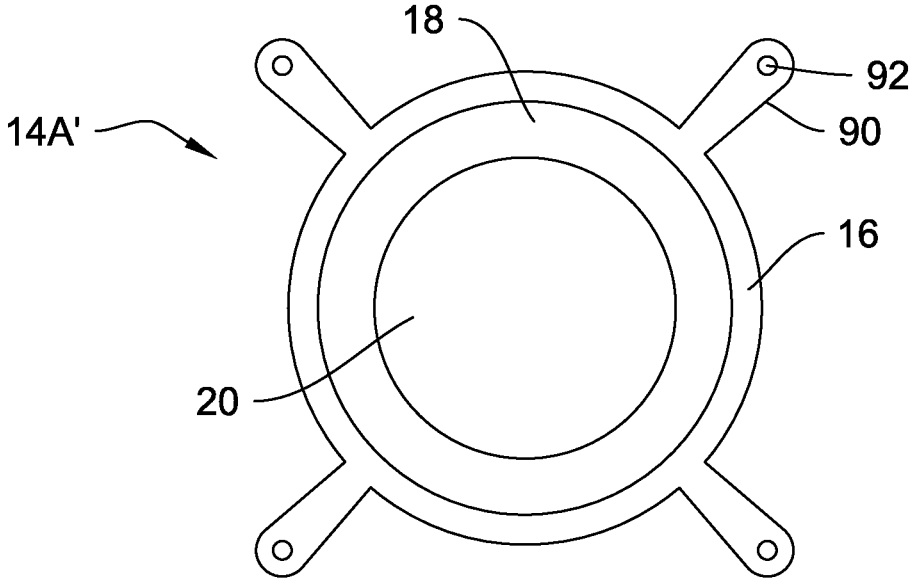
FIG. 7 is a view of an alternate embodiment of a half shell.

FIG. 7 shows an alternate embodiment of a half shell 14A'. Like the shell described in FIG. 1, half shell 14A' has an outer flange 16, a transition region 18, and an inner region 20. This embodiment includes alignment tabs 90. Each alignment tab 90 has a pin aperture 92 formed therein. (Another half shell, 14B' can be substantially the same shape as 14A'.) Alignment tabs 90 and pin apertures 92 are provided to insure alignment of half shells 14A' and 14B' as will be described hereinafter.

Figure 8:
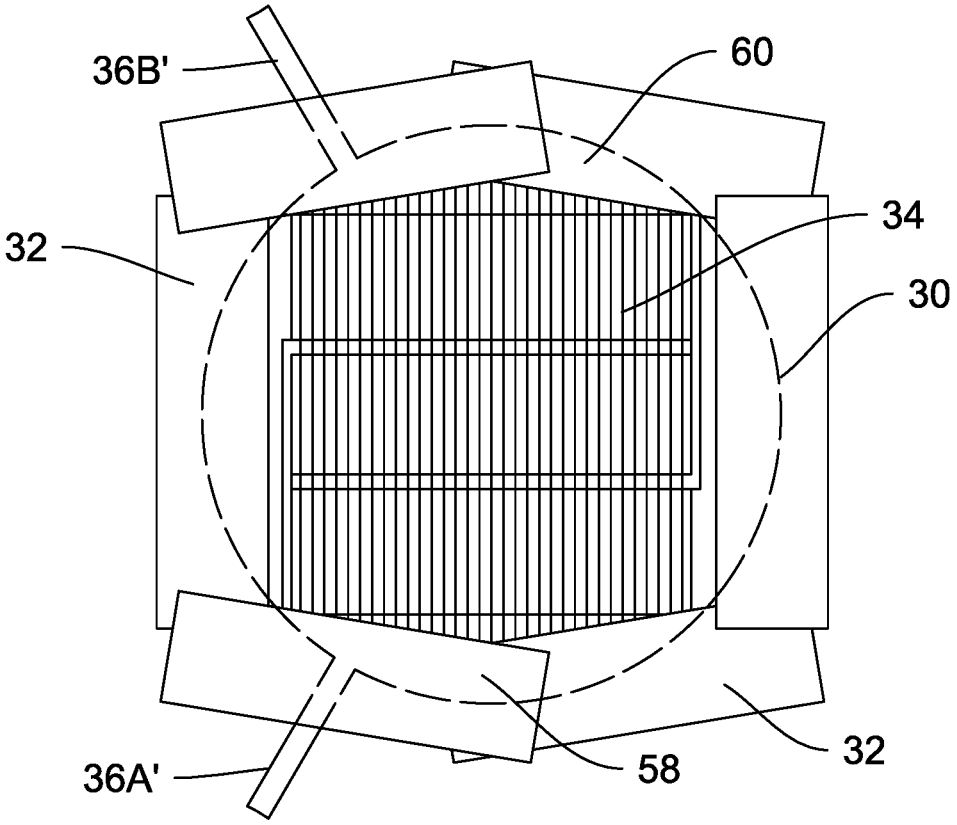
FIG. 8 is a detail view of an alternate embodiment of the substrate and thermoacoustic element with tab sealant strips.

FIG. 8 illustrates further steps in making the packaged thermophone featuring an alternate embodiment. As shown in FIG. 3, a substrate 30 is provided with carbon nanotubes 34 adhered thereon in contact with electrodes 58 and 60. This embodiment utilizes conductive tabs 36A' and 36B' in contact with electrodes 58 and 60 to provide a signal to the thermophone. For assembly, tab sealant strips 32 are provided around the periphery of the substrate 30.

On assembly, half shells 14A and 14B are positioned on top of tab sealant strips 32 and below tab sealant strips 32. This will result in the tab sealant strips 32 being positioned between outer flanges 16. Heat treatment and compression is applied to the exterior of flanges 16. Heat treatment causes partial melting of tab sealant strips 32 and adhesion of half shell 14A to half shell 14B. Substrate 30 will be suspended at an intermediate location in cavity 22 as shown in FIG. 2.

Half shell embodiments 14A' and 14B' can be assembled utilizing a jig to properly align shells 14A' and 14B'. The jig (not shown) would have four pins corresponding to pin apertures 92. In use, bottom shell 14B' is positioned on the pins with the concave side facing upward. Assembled substrate 30, tab sealant strips 32, and other components would be positioned on bottom shell 14B'. Top shell 14A' is positioned above the assembly on the pins with the concave side facing downward. Heat treatment is applied to outer flanges 16.

Figure 9:
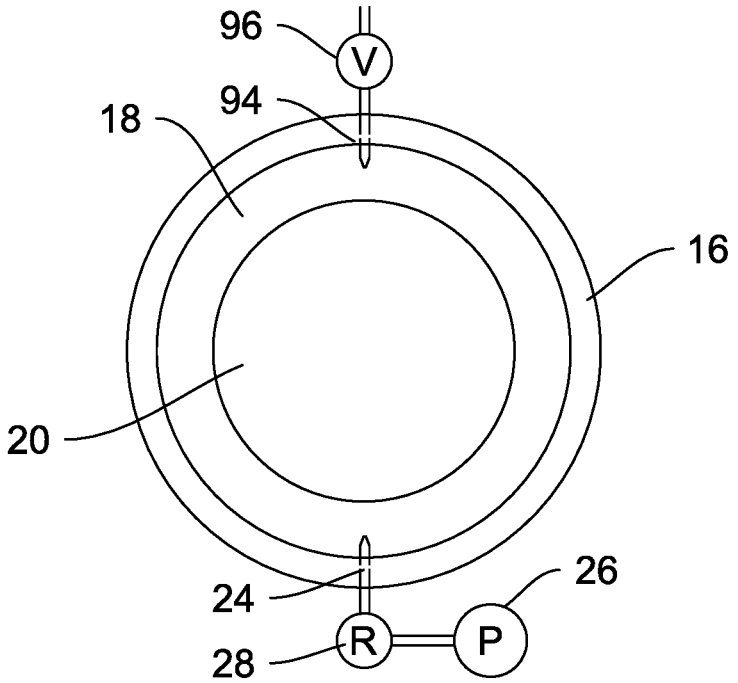
FIG. 9 is a top view of an alternate embodiment of the thermoacoustic device.

FIG. 9 displays an alternate embodiment of the assembled thermophone. Shell 12 is provided with pressurization tube 24 and an outlet tube 94. Like pressurization tube 24, outlet tube 94 provides gaseous communication between cavity 22 and the exterior of shell 12. A valve 96 is provided on outlet tube 94 to seal it. Outlet tube 94 can be used when filling cavity 22 with a gas to allow discharge of the existing gas in cavity 22. This is useful for purging environmental gas present in cavity 22 after assembly and incorporation of an inert gas such as argon. Outlet tube 94 can also be used to vent gas in cavity 22 if the gas in cavity 22 becomes over pressurized with relation to the environment.

The foregoing description of the preferred embodiments of the invention has been presented for purposes of illustration and description only. It is not intended to be exhaustive, nor to limit the invention to the precise form disclosed; and obviously, many modification and variations are possible in light of the above teaching. Such modifications and variations that may be apparent to a person skilled in the art are intended to be included within the scope of this invention as defined by the accompanying claims.

What is claimed is:

1. A thermoacoustic device comprising:

an outer shell having a first half shell and a second half shell, each half shell having an outer flange and an inner region, said first half shell and said second half shell being joined at the outer flanges of the half shells such that the combined half shell inner region defines an inner cavity;

a gas within said outer shell inner cavity;

a substrate having at least two electrodes disposed thereon, said substrate being supported between said outer shell first half shell outer flange and said outer shell second half shell flange;

a thermoacoustic element having a first end and a second end, said thermoacoustic element mounted on said substrate with the first end in contact with one said substrate electrode and the second end in contact with another said substrate electrode; and at least two leads, each lead being joined to one substrate electrode and positioned to have one end within said outer shell inner cavity and the other end outside said outer shell.

2. The apparatus of claim 1 further comprising a pressurization tube in communication between said outer shell inner cavity and said outer shell exterior for providing said gas.

3. The apparatus of claim 2 further comprising:

a regulator joined to said pressurization tube for regulating the pressure of said gas within said outer shell inner cavity; and a gas source joined to said regulator for provision of said gas.

4. The apparatus of claim 3 wherein said gas is argon.

5. The apparatus of claim 3 further comprising:

an outlet tube in communication between said outer shell inner cavity and said outer shell exterior for allowing discharge of said gas; and an outlet valve joined to said outlet tube for allowing and preventing flow through said outlet tube.

6. The apparatus of claim 1 wherein said thermoacoustic element is an array of carbon nanotube fibers extending continuously from said thermoacoustic element first end to said thermoacoustic element second end.

7. The apparatus of claim 1 further comprising a tab sealant positioned between said outer shell first half shell flange and said outer shell second half shell flange, said tab sealant being joined to said substrate to support said substrate in the inner cavity.

8. The apparatus of claim 1 wherein:

said substrate has an aperture formed therein with said at least two electrodes disposed on said substrate at opposite sides of the aperture; and said thermoacoustic element being mounted on said substrate to traverse said substrate aperture such that a middle portion of said thermoacoustic element is unsupported by said substrate.

9. The apparatus of claim 1 wherein:

said substrate has at least two aperture formed therein, said substrate between the at least two apertures being a support region; and said thermoacoustic element being mounted on said substrate to traverse said substrate at least two apertures such that a middle portion of said thermoacoustic element is supported by said substrate support region.

10. The apparatus of claim 9 wherein said substrate electrodes contact said thermoacoustic element at the first end, the second end, and the middle portion for providing electrical current to portions of said thermoacoustic element less than the entire length thereof.

11. The apparatus of claim 9 further comprising a pressurization tube in communication between said outer shell inner cavity and said outer shell exterior for providing said gas.

12. The apparatus of claim 11 further comprising:

a regulator joined to said pressurization tube for regulating the pressure of said gas within said outer shell inner cavity; and a gas source joined to said regulator for provision of said gas.

13. The apparatus of claim 12 wherein said gas is argon.

14. The apparatus of claim 12 further comprising:

an outlet tube in communication between said outer shell inner cavity and said outer shell exterior for allowing discharge of said gas; and an outlet valve joined to said outlet tube for allowing and preventing flow through said outlet tube.

15. The apparatus of claim 1 further comprising:

at least two mounting fixtures, each having a central aperture for accommodating said outer shell inner regions, said mounting fixtures having mounting apertures arranged around the periphery thereof and extending longitudinally therethrough; and fasteners positioned in said mounting fixture apertures, said mounting fixtures being secured to compress said outer shell flanges between said fixtures by said fasteners.

* * * * *